United States Patent [19]

Glavic

[11] 4,429,461

[45] Feb. 7, 1984

[54] DEVICE FOR CUTTING VINYL SHEET FLOORING

[76] Inventor: Joseph J. Glavic, 3247 Potomac Dr., Brunswick, Ohio 44212

[21] Appl. No.: 380,086

[22] Filed: May 20, 1982

[51] Int. Cl.[3] ..... B25H 7/00

[52] U.S. Cl. ..... 30/289; 33/174 G

[58] Field of Search ..... 30/286, 289; 33/32 R, 33/32 B, 174 G

[56] References Cited

U.S. PATENT DOCUMENTS

| | | | |
|---|---|---|---|
| 2,057,250 | 10/1936 | Sanger | 30/289 X |
| 2,814,163 | 11/1957 | Krulwich | 33/32 B |
| 3,678,586 | 7/1972 | Weber | 33/174 G |
| 3,772,793 | 11/1973 | Anderson | 30/289 X |

FOREIGN PATENT DOCUMENTS

| | | | |
|---|---|---|---|
| 2354178 | 1/1978 | France | 30/286 |

*Primary Examiner*—Jimmy C. Peters
*Attorney, Agent, or Firm*—Alfred D. Lobo

[57] ABSTRACT

This invention is directed to solving the problem of matching first and second roll-portions of grouted-tile-pattern linoleum roll stock along the longitudinal edges thereof, so as to maintain the overall repeating grouted-tile pattern ("field") without showing the joint. The problem is solved by a remarkably simple implement for cutting the grouted-tiled-pattern linoleum roll stock along a longitudinally continuous grout line with a manually operable blade means, by making no measurement other than visually inspecting the width of the grout line through spaced apart apertures in an elongated relatively thin metal laminar strip member, and positioning its longitudinal edge, nearest the apertures, on the salvage edge in such a way as to leave a predetermined width thereof when cut with the blade's manually guided edge.

8 Claims, 5 Drawing Figures

DEVICE FOR CUTTING VINYL SHEET FLOORING

BACKGROUND OF THE INVENTION

This invention relates to a single purpose implement, this purpose being to cut and match "grouted-tile-pattern" vinyl sheet floor covering, commonly referred to as 'linoleum roll stock', so that pieces of stock may be abutted longitudinally, precisely matching the pattern but without showing the "joint" (that is, the line along which adjoining pieces of stock are longitudinally joined). By "grouted-tile-pattern" stock, I refer to linoleum in which individual tiles are laid out geometrically and grouted between each tile so as to form a "field" of repeating geometrical patterns such as are disclosed in product catalogues of manufactures of such rolled stock, for example Armstrong, Congoleum, G.A.F., Mannington Mills, Biscayne Corporation, and the like, the patterns from which catalogues are incorporated by reference thereto as if fully set forth herein.

More specifically, I refer to linoleum roll stock with simulated grouted tile patterns which stock is normally available in rolls either 6 feet wide or 12 feet wide, and of arbitrary length. Some roll stocks are quite flexible, with considerable "give" (referred to as "cushioned floors"), while other are relatively stiff (referred to as "inlaid floors"). Such roll stock to which this invention applies closely duplicates the visual impact of (a) ceramic tile floors in which individual tiles are separated by a cementitious material ("grouting"), or (b) brick or stone floors in which individual bricks or stones are separated by grouting. As is well known, ceramic tile floors are extremely durable and have a timeless beauty peculiar to such floors in which tiles are manually set and grouted in substantially uniform relationship with each other. It is this substantially uniformly spaced apart relationship, which, because it is not perfectly uniform imparts the characteristic "look" of a manually laid tile floor.

As presently conventionally done, a pair of linoleum sheets ("roll-portions") are longitudinally matched by an average linoleum flooring installer ("floor mechanic") who cuts the "salvage edge" while kneeling on the linoleum and measuring the width of the stock along a line he wishes to cut. He then marks the linoleum at several locations, longitudinally, with the blade of the cutting knife, or a colored pencil, places a straight edge along the marks and cuts the roll longitudinally for a distance of from 2 to 3 feet. He then moves himself on his knees along the straight edge without moving it, and continues the cut for another 1 or 2 feet, having thus made a cut of about 4 feet in total length without moving the straight edge. He then makes additional measurements and repeats the process to make a continuous incision as he moves intermittently along the length of the stock. Instead of measuring and marking the linoleum, he may overlap a first and second roll-portion (or "sheet") so that the "field" is matchingly repeated, and he then cuts both portions simultaneously so that they have a common linear edge which may be abutted without showing the joint. Though overlapping and cutting two sheets simultaneously solves the problem of obtaining a flush joint, and matched in this sense, the problem of matching the field precisely, remains, since he cannot see the precise width of grouting to be left on the bottom sheet when it is overlapped with a second sheet. How accurately he makes the longitudinal cut, both with respect to obtaining a flush joint, and, a precisely matched field, irrespective of which method he uses, will determine how well he solves the problem of "hiding" the joint he makes.

This problem of forming a matching joint between a first and second roll-portion of a pair of linoleum roll-portions has been addressed over a period of decades and numerous solutions have been proffered. None has been addressed to the specific problem of satisfactorily matching longitudinal grouting patterns in grouted-tile-pattern roll stock.

For example, U.S. Pat. No. 2,383,368 teaches a device for making a beveled straight lateral cut, but there is no provision for visually inspecting the lateral portion of the stock being cut, which lateral portion is contiguous to the cut edge. The most notable feature of the device is that it permits cutting with a blade without the blade being drawn against a guiding straight edge. As will be evident, if a blade is drawn against a straight edge made of steel or other hard material the blade will tend to be dulled more quickly than if it was cutting only the linoleum. Stated differently, once the longitudinal path is set along which the holder of the blade is to traverse, there is no means for visually determining the precise line along which the blade is cutting, until after the "blind" cut is made. It will be evident that it is more preferable to be able to observe the precise line to be cut, before it is cut, and to make such adjustments as might be deemed necessary. It will also be evident that it would be preferable not to use a blade holder because of the error that is introduced in mounting the blade, and then preserving its mounting accurately while the blade is being used.

U.S. Pat. No. 2,487,237 discloses a device which allows the line of cutting to be inspected visually just before the cut is made and if the machine is guided along a straight edge, it would be capable of making a longitudinal cut in the roll stock. The adequacy of the cut, judged by how well the pattern is matched and the joint between adjoining sheets of linoleum is hidden, will depend upon the expertise of the cutter and the steadiness of his hand, not to mention other factors such as the sharpness of the blade, inter alia.

The cost of the machine such as is disclosed in the +237 patent militates against its use by a floor mechanic with normal financial resources, and the maintenance and operation of such a machine is beyond the ordinary skill of a floor mechanic. There is a pressing need for a simple and inexpensive implement which will faciliate the laying of grouted-tile-pattern linoleum roll stock because the implement is efficient, easy to use quickly, and accurate to make an incision manually with a blade, along a longitudinal grout line in the salvage edge so as to enable a pair of adjoining linoleum sheets to be joined precisely without noticing the joint. The device of this invention is such an implement. I know of no prior art device which permits a flooring man to lay a floor with grouted-tile-pattern linoleum roll stock as simply, effectively and easily as the device of my invention.

SUMMARY OF THE INVENTION

It has been discovered that the problem of matching first and second roll-portions of grouted-tile-pattern linoleum roll stock along the longitudinal edges thereof, so as to maintain the overall repeating grouted-tile pattern without showing the joint, stems for the most part from (a) an inability to visually align a boundary of a linearly continuous simulated grouting before cutting through it to match another boundary, as is the case with overlapping edges of sheets and cutting through them, and (b) errors in measuring and marking one of the sheets and cutting through the marks.

It is therefore a general object of this invention to provide an implement for grouted-tile-pattern linoleum roll stock which implement comprises a combined visual gauge and guide laminar member of relatively thin metal having see-through rectangular apertures, serving as "sights", which member permits a manually operable blade means to be moved along its exterior longitudinal edge which is nearer the apertures, so as to cut the stock. The cut salvage edge of stock is left with a vertical face which facilitates precise abutment for a hidden joint.

A specific object of this invention is to provide a remarkably simple implement for cutting grouted-tiled-pattern linoleum roll stock along a longitudinally continuous grout line with a manually operable blade means, by making no measurement other than visually inspecting the width of the grout line through spaced apart apertures in an elongated relatively thin metal laminar strip member, and positioning its longitudinal edge, nearest the apertures, on the salvage edge in such a way as to leave a predetermined width thereof when cut with the blade's manually guided edge.

BRIEF DESCRIPTION OF THE DRAWINGS

The foregoing and other objects and advantages of my invention will appear more fully from the following description, made in connection with the accompanying drawings, of a preferred embodiment of the invention, wherein like reference characters refer to the same or similar parts throughout the several views, and in which.

DETAILED DESCRIPTION OF PREFERRED EMBODIMENTS

Figure 1:
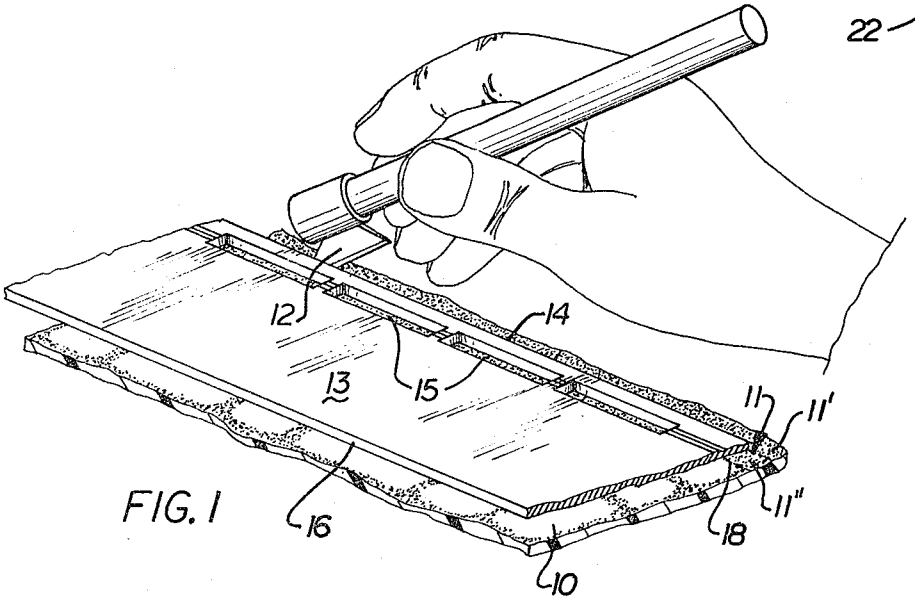
FIG. 1 is a perspective view from a slight elevation of the device of this invention as used to cut grouted-tile-pattern linoleum roll stock.

A detailed description of the invention is desirably preceded with a definition of the problem solved by the invention, referring particularly to a typical grouted-tile-pattern in linoleum roll stock, a portion of which is illustrated in FIG. 1. There is schematically shown, in slightly elevated, perspective view, the implement of this invention being used to trim a longitudinal "salvage" edge of a first roll-portion 10 of stock which is to be abutted against a longitudinal edge of a second roll-portion of stock (not shown). Numerous patterns of grouted tile are available, but what they all have in common is a linear, either continuous or interrupted grouting along a salvage edge which is to be joined to another roll-portion without showing the joint, and without disrupting the overall repeating pattern ("field").

Typically, this longitudinal salvage edge of linoleum stock has embossed or otherwise imprinted on its surface, a linearly continuous simulated grouting ("grouting" for brevity) indicated by reference numeral 11, which grouting is too wide to be abutted, as is (without being trimmed), against a longitudinal salvage edge of a second roll-portion of the same stock. The combined width of the longitudinal grouting in the patterns of the abutted roll-portions would be too wide and inappropriate in the overall field. Therefore, a portion′ (trimmed portion) of the salvage edge 11 is to be longitudinally trimmed so as to leave a portion 11″ (remaining portion) which is the precise width required to duplicate the width of grouting (at that joint), so as to fit in the field precisely. This is normally done by manually cutting through the salvage edge 11 with a blade means 12 which is drawn against a conventional straight edge, appropriately located in the usual manner, so as to align its edge with marks made in the linoleum. The problem is to leave precisely the right width of remaining portion 11″ so that the longitudinal edges of the first and second roll-portions can be satisfactorily matched without making any measurement, other than visual, and without making any marks in the linoleum before it is trimmed. If this can be done without sacrificing accuracy, it would save time which is a critical economic factor in laying linoleum roll stock.

Figure 2:
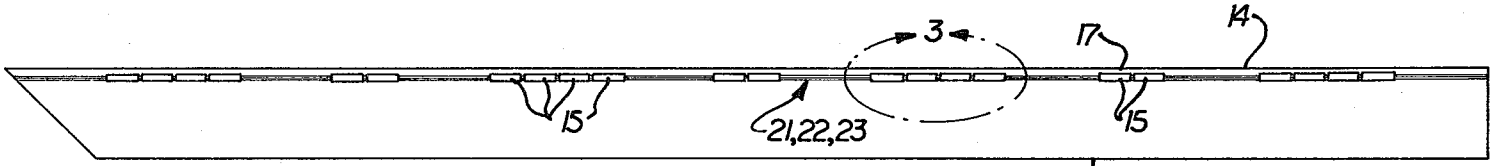
FIG. 2 is a plan view of a combination visual gauge and metal guide member, showing rectangular apertures spaced apart from the nearer longitudinal edge by a marginal portion.

The foregoing problem has been solved by the implement of this invention, shown in plan view in FIG. 2, which includes a combined visual gauge and guide member, indicated generally by reference numeral 13, having a longitudinal edge 14 against which blade means 12 is held and drawn. this edge 14 is the guiding edge for the blade and the only guiding edge for cutting, because of its specific relationship to the apertures 15, described in greater detail hereinafter.

The member 13 is a laminar, elongated, generally rectangular metal strip of bronze or ferrous metal, preferably stainless steel, having a thickness in the range from about 0.02″ (inch) to about 0.25″, and at least 3′ (feet) long. More preferably the member 13 is from about 3′ to about 6′ long, and most preferably about 4′ long. The member cannot be made from soft metal or a synthetic resinous material because it will not be essentially immune to damage from the blade during use, and it cannot practically be constructed of transparent glass which is frangible and ill-suited for commercial use. Further, synthetic resins, whether opaque or not, are prone to distortion over a period of time, and it is critical that the longitudinal edge 14 of the member 13 be straight.

The width of the member 13 is necessarily at least 1″ wide so as to be able to locate the member on the linoleum by exerting a downward force on it, and more preferably from about 2″ to 5″ wide to allow the member to be located by kneeling on it. The thickness of the member is such that it is flexible enough to follow closely any unevenness in the surface of the linoleum, though it is also essential that the member 13 be relatively thin to prevent its edges from casting a distracting shadow on the linoleum, which shadow would make it difficult to see where the cut is to be made, and how well the desired portions of the tile pattern are matched, before the cut is made. For the best joint "fit" it is desirable that the manually made cut be vertical, that is, have a vertical, unbeveled face.

Near one longitudinal edge 14, the member 13 is provided with a plurality of longitudinally spaced apart rectangular apertures 15, this edge being the edge against which the blade means 12 is to be drawn. The edge 14 is critically linear within a tolerance of ±0.010" over the entire length of the member. The other edge 16 provides no particular critical purpose. One aperture edge 15' (longitudinal edge of aperture 15) is spaced apart from the longitudinal edge of the member 13 by a distance which corresponds to the narrowest grouting width in the field, typically 0.1875", and the longitudinal edges 15' of all the apertures 15 are aligned so as to be parallel to longitudinal edge 14 of the member 13. The purpose of the row of aligned apertures is to be able to see the inner boundary 18 of the grouting 11 therewithin, so as to visually determine pecisely where the longitudinal edge 14 of the member 13 is to be located. The width of each aperture is not critical provided it is wide enough to examine the inner boundary 18 of the grouting 11 to be trimmed. Typically the apertures are from about 0.375" to about 0.5" wide and from about 0.5" to about 6.0" long, and when their edges 15' are aligned, as they must be, they will provide a narrow marginal portion 17 of uniform width in the member 13 which marginal portion has a width corresponding to the minimum thickness of grouting in the tile pattern, as mentioned hereinabove.

Figure 3:
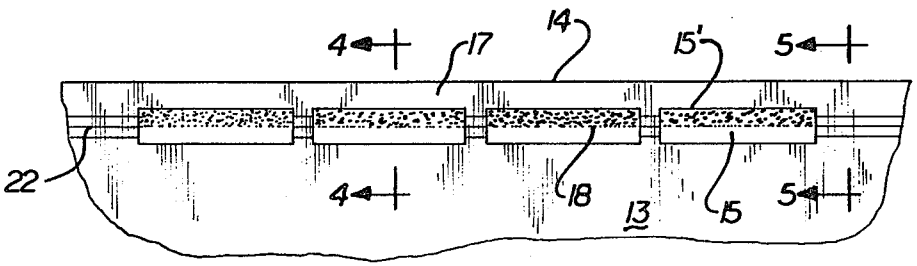
FIG. 3 is a plan view of a portion FIG. 2, shown in enlarged detail, with the visual gauge and guide member placed on a longitudinal salvage edge of roll stock, after a predetermined width of salvage has been trimmed, showing the inner boundary of the remaining portion of salvage visible in the apertures.
Figure 4:
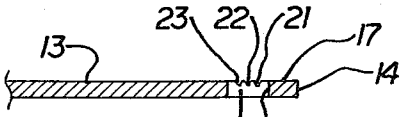
FIG. 4 is a cross section along the lines 4—4 in FIG. 3 showing reference marks scored in the metal separating successive apertures.
Figure 5:
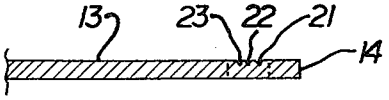
FIG. 5 is a cross sectional view along the line 5—5 showing a portion of FIG. 3, between apertures, in which the reference marks are scored in the metal.

Since it is critical that the aperture edges 15" be located visually so as to display a preselected amount of grouting within the apertures, and to align this display within the serially aligned plural apertures so as to have the precise width of remaining portion 11" of grouting, it is essential that the inner boundary of the salvage edge be visible within the apertures where the inner boundary of the salvage edge be visible within the apertures where the inner boundary can be properly aligned before the member 13 is located for making the cut. To assist in aligning the inner boundary, one or more reference marks 21, 22 and 23 are provided, longitudinally, between the apertures, for substantially the entire length of the member 13, as is illustrated in FIGS. 4 and 5, should the width of grouting 11" be greater than the width of the marginal portion 17. Fewer reference marks may be provided, but it is desirable to have marks at each end of the member 13, and at each end of each set of apertures. As is more readily evident in FIG. 3, inner boundary 18 is aligned with reference mark 22 across the length of each aperture, before a cut is made.

Since member 13 is a combined visual gauge and guide with no quantitatively fixed measuring marks such as divisions for fractions of an inch, or centimeter thereon, it carries only the reference marks which correspond to the widths of grouting usually and commonly provided in grouted-tile-pattern linoleum roll stock. To observe the reference inner boundary of a salvage edge effectively, it is necessary to have an aperture at least every 6" so as to facilitate sighting of the reference inner boundary. An effective arrangement of "sights" is to provide relatively small apertures about 1" long and about 0.25" wide in repetitively spaced apart groups of two and four apertures, as shown in the drawing. If desired, plural wider apertures may also be provided for those instances where it might be desired to sight a wider portion of a relatively wide salvage edge.

One end of member 13 is provided with a 45° wedge 19 to facilitate pivoting the member 13 about the wedge's point, when the point is placed against a base of a wall surface.

To use the implement of this invention, a flooring man simply lays the member 13 on the field and aligns the cutting edge 14 of the marginal portion 17 along the outer boundary of the field grout line. He now observes where the inner boundary of the grout line is aligned relative to the reference marks 21, 22 and 23, or relative to the longitudinal edges of the apertures. He notes which particular reference mark (say 22) is aligned with the inner boundary of the field grout line, and this determines the width of the grout line to be cut from the salvage edge. He then transfers the member 13 to the salvage edge and aligns the inner boundary of the grout line at this edge with the noted reference marks 22. He then locates the member by exerting a force on it, preferably by placing his knee on it, then manually makes an incision with a sharp cutting blade 12 along the longitudinal edge of the member 13, which edge is nearest the aligned apertures 15, without moving the member, for a distance through which his arm can comfortably travel while making the incision. He then moves himself along the member, on his knees, without moving the member, and continues the cut for substantially the entire length of the member. He then moves the member longitudinally while aligning its longitudinal edge 14 (nearest the apertures) with the incision made, and then again fixedly locates the member, as before, and repeats the process step of making an incision along the line until a sufficient length of the first roll-portion is cut to match a corresponding length of a second roll-portion to which it is to be joined.

Typically, a floor mechanic will determine the width of grouting he desires (by the procedure described hereinabove) and trim the excess from the salvage edge of the first roll-portion. Since the second roll portion of stock which is to be abutted to the trimmed first portion will not require any grouting, (the first roll portion already having the precise width required by the field), the entire width of grouting will be trimmed ffrom the salvage edge of the second roll portion. When the first and second roll portions are abutted, the pattern of the field will have been precisely matched and the joint will be effectively hidden. It will be evident to a floor mechanic that, should the need arise, he may just as easily trim a portion of the grouting from the salvage edge of the second roll portion, and all the grouting from the first roll portion; or, if the need arises, he may leave a portion of the required width of grouting on the first roll portion and then trim the grouting on the second roll portion to have a sufficient width so that when the first and second roll portions are abutted, the desired width of grouting in the field will have been duplicated.

I claim:

1. An implement for cutting grouted-tile-pattern vinyl sheet floor covering ("linoleum roll stock") longitudinally along a line in linearly continuous simulated grouting in the linoleum's surface, said implement comprising, (a) a laminar, elongated, generally rectangular metal, combined visual gauge and guide member having a thickness in the range from about 0.020" (inch) to about 0.25" thick, (b) a continuous marginal portion defined by an exterior edge of said member and aligned outer edges of plural longitidunally spaced apart rectangular apertures in said member, said marginal portion having a thickness corresponding to the minimum width of grouting in said tile-pattern of a first roll-portoion of said linoleum roll stock, so as to enable a boundary of said grouting to be visible within said apertures, and, (c) manually operable blade means to be guided in contact with said exterior edge so as to cut along a line in said linearly continuous grouting, leaving a predetermined portion of said grouting, which enables said first roll-portion to be abutted to a second roll-portion of said linoleum, so as to maintain a predetermined uniform width of said continuous grouting and match the overall grouted-tile-pattern without showing the joint.

2. The implement of claim 1 wherein said marginal portion is from about 0.125″ to about 0.50″ wide.

3. The implement of claim 2 wherein said rectangular apertures are each in the range from about 0.375″ to about 0.5″ wide and from about 0.5″ to about 6.0″ long.

4. the implement of claim 3 wherein said apertures are spaced apart at a distance close enough to visually follow an inner boundary of said linearly continuous grouting.

5. the implement of claim 4 including plural parallel longitudinally spaced apart linear reference marks for visually aligning an inner boundary of said linearly continuous grouting within said apertures so as to align said inner boundary for substantially the entire length of said member.

6. The implement of claim 5 having an overall width in the range from about 2″ to about 5″ so as to be flexible about an axis at right angles to the longitudinal axis of said member, allowing it to closely follow said surface when it is uneven, and allowing said member to be intermittently fixedly located along said contnuous grouting by force exerted by the user of said implement.

7. A method for longitudinally abutting a first roll-portion of grouted-tile-pattern linoleum roll stock to a second roll-portion of the same roll stock so that the portions are flush-joined and the patterns are matched without showing the joint, comprising, (a) laying a combined visual gauge and guide member of metal having plural aligned spaced apart apertures on the surface of said first roll-portion along a continuous longitudinal simulated grouting therein, said member being laminar, elongated and generally rectangular, (b) visually aligning the inner boundary of said grouting within said plural apertures so that said inner boundary is parallel to a longitudinal edge of said apertures and the distance between said inner boundary and the longitudinal edge of said member corresponds to a predetermined width corresponding to a width in said pattern, (c) fixedly locating said member by placing weight thereon, (d) manually making an incision with a blade means along said longitudinal edge of said member without moving said member, then (e) moving said member longitudinally while aligning said edge with the incision made, again fixedly locating said member, and, (f) again making another incision so as to make a continuous incision along the length of said first roll-portion for a distance sufficient to match said second roll-portion.

8. The method of claim 7 wherein said continuous longitudinal simulated grouting is part of the salvage edge of said first roll-portion, and said grouting is cut longitudinally to provide a width of grouting to match a width in the field, said second roll-portion is also provided with a salvage edge having a longitudinal simulated grouting, and said method includes the step of eliminating the grouting in the salvage edge of said second roll-portion.

* * * * *